United States Patent [19]

Matkan

[11] 4,307,169

[45] Dec. 22, 1981

[54] MICROCAPSULAR ELECTROSCOPIC MARKING PARTICLES

[75] Inventor: Josef Matkan, Malvern, Australia

[73] Assignee: Moore Business Forms, Inc., Grand Island, N.Y.

[21] Appl. No.: 128,906

[22] Filed: Mar. 10, 1980

[51] Int. Cl.[3] ..... G03G 9/08

[52] U.S. Cl. ..... 430/111; 430/98; 430/138; 430/107; 430/110; 428/403; 428/407; 252/316; 264/4

[58] Field of Search ..... 430/111, 98, 124, 110, 430/138; 428/403, 407; 264/4; 252/316

[56] References Cited

U.S. PATENT DOCUMENTS

| | | | |
|---|---|---|---|
| 2,986,521 | 5/1961 | Wielicki | 430/110 |
| 3,429,827 | 2/1969 | Ruus | 252/316 |
| 3,473,923 | 10/1969 | Ohkubo et al. | 430/120 |
| 3,516,941 | 6/1970 | Matson | 430/111 X |
| 3,893,932 | 7/1975 | Azar et al. | 430/111 X |
| 3,981,821 | 9/1976 | Kirtani | 252/316 |
| 4,220,698 | 9/1980 | Brynko et al. | 252/316 X |

*Primary Examiner*—John D. Welsh

*Attorney, Agent, or Firm*—Kinzer, Plyer, Dorn & McEachran

[57] ABSTRACT

Electroscopic marking particles comprising microcapsules consisting of a pressure fixable core and pressure rupturable shell which is characterized by the core comprising pressure fixable material and coloring matter and the shell is formed by interfacial polycondensation.

10 Claims, No Drawings

MICROCAPSULAR ELECTROSCOPIC MARKING PARTICLES

BACKGROUND OF THE INVENTION

It is well known to tone electrostatic latent images contained on photoconductive or dielectric surfaces by application thereto of electroscopic marking particles. It is also known to have electroscopic marking particles in dry form which can be fixed by pressure onto the photoconductor which may comprise a sheet of paper coated with photoconductive Zinc Oxide in a resinous binder or which electroscopic marking particles can be transferred from the photoconductor onto plain paper and affixed thereto by pressure. Electroscopic marking particles which can be fixed by pressure are generally referred to as pressure fixing dry toner.

Pressure fixing dry toner compositions of encapsulated and non-encapsulated type are also well known. Encapsulated toners are disclosed for instance in U.S. Pat. Nos. 3,080,250, 3,080,251, 3,080,318, 3,893,932 and 3,893,933. Pressure fixing toners of non-encapsulated type are disclosed for instance in U.S. Pat. Nos. 3,788,994, 3,804,764, 3,873,325, 3,903,320 and 3,925,219.

Encapsulated dry toners of the prior art methods disclosed have inherent limitations with regards particle size control, quantity and type of coloring matter which can be encapsulated, capsular shell thickness and inertness.

In each of the prior art disclosures the fixing pressures disclosed are very high, being generally within the range 200–500 pounds/lineal inch. In the past it was considered that pressure fixing toners were of necessity formulated to require high fixing pressure in order that such materials should possess suitable physical characteristics for normal handling purposes.

SUMMARY OF THE INVENTION

It is the object of the present invention to provide electroscopic marking particles that is dry toner material in the form of microcapsules of controlled size wherein high intensity coloring matter can be encapsulated within an inert capsular shell and wherein such capsular shell allows fixing by relatively low pressure yet permits easy handling of the dry toner material.

DESCRIPTION OF THE INVENTION

In accordance with the present invention electroscopic marking particles are prepared in the form of microcapsules following in general the encapsulation teachings of H. Ruus as disclosed in U.S. Pat. No. 3,429,827 and G. E. Maalouf as disclosed in U.S. Pat. No. 4,000,087, each of which is incorporated herein by reference. The technique disclosed therein is generally referred to as interfacial polycondensation, in which process a non-aqueous phase containing one reacting material is emulsified in an aqueous phase containing a second reacting material. Reaction is arranged to occur under constant agitation to produce microdroplets of the non-aqueous phase encapsulated in a shell comprising the reaction product formed at the phase interface, such shell preferably comprising a substantially impervious polyamide or other polymeric compound.

Microcapsules prepared by the interfacial polycondensation process have several advantage characteristics over microcapsules of other types in that the capsule size can be very accurately controlled within the size range 1–40 microns, the shell is substantially non porous and inert to the encapsulated material, the shell is resistant to environmental changes and rupture resistance of the capsules can be predetermined by control of capsule size and/or thickness of the shell as well as by the addition of an inner shell.

We have now found that by the interfacial polycondensation process it is possible to produce electroscopic marking particles that is dry powder toner material in the form of microcapsules.

The microcapsular electroscopic marking particles in accordance with this invention comprise colored encapsulated pressure fixable substance contained within a pressure rupturable shell and a residue layer over such shell as will be described in detail in the following.

The substance to be encapsulated in accordance with this invention comprises in essence an ink, a first reactive substance and a carrier for said ink and said first reactive substance.

The ink in accordance with this invention comprises coloring matter which may be organic or inorganic pigment, magnetite or ferrite or other magnetizable substance, dyes which may be present in particulate state or in dissolved state or in absorbed or adsorbed state associated with the pigment or magnetizable substance, binder material for said coloring matter such as mineral and vegetable oils, natural and synthetic resins, bituminous substances, rubber or other elastomers, waxes, plasticizers, aliphatic or aromatic hydrocarbon solvents, antioxidants, viscosity modifying agents, metallic soaps, alkyl aryl compounds, phosphatides such as lecithin, bitumens or asphalts, sulphur containing compounds such as sulphosuccinates and such like substances.

The carrier medium for said ink may comprise a solvent or a plasticizer such as for instance dibutyl phthalate or the like substance having dispersed therein said ink and having dissolved therein said first reactive substance.

To form for instance a polyamide shell in accordance with the interfacial polycondensation process there is first prepared a water phase that is an aqueous solution of an emulsion stabilizer such as polyvinyl alcohol or hydroxy ethyl cellulose or cellulose gum and the like and then in such solution the aforementioned substance to be encapsulated in accordance with this invention is dispersed to form an emulsion. Following such emulsification of said substance to be encapsulated the second reactive substance which is an amine containing substance such as diethylene triamine or the like in aqueous solution which may also contain a pH stabilizer such as sodium carbonate or the like is added to such emulsion under agitation and such agitation is continued for some time until a polycondensation product that is polyamide is formed as a shell at the interface between the emulsified droplets or globules of the substance to be encapsulated and said water phase due to reaction between said first and second reactive substances contained in said substance to be encapsulated and said water phase, respectively.

Said water phase may also contain therein in dispersed or dissolved state protective colloids and surface active agents of the anionic, cationic or non-ionic type and the like, which substances may adsorb onto or be absorbed by or react in part with the shell.

Upon completion of the interfacial polycondensation process there is formed an aqueous slurry containing therein in suspended state microcapsules and in dissolved or dispersed state at least part of the aforementioned emulsion stabilizer, protective colloid and surface active agent. Such slurry can be spray dried to form discrete capsular particles which contain on the outer shell wall in dry form and adsorbed thereto or absorbed thereby or in part reacted therewith a residue layer consisting of said emulsion stabilizer, protective colloid and surface active agent, such dry discrete capsular particles or agglomerates thereof constituting the electroscopic marking particles in accordance with this invention.

The pressure required to rupture the microcapsular electroscopic marking particles in accordance with this invention depends mainly on the size of the microcapsules and on the thickness and robustness of the shell, and it will be obvious that of course relatively large and thin shell capsules are easier to rupture by pressure than those of smaller size, as a general rule. The capsule size can be precisely controlled by the selection of appropriate speed of stirring or mixing during the aforementioned step of emulsification and/or of the duration of such step of emulsification and it is also possible to control particle size additionally by varying the proportion of the aforementioned emulsion stabilizer in the aqueous solution that is in the water phase as well as by varying the proportion of the substance to be encapsulated when emulsifying in the water phase. The robustness of the capsular shell can be precisely controlled by varying the proportion of the two aforementioned reactive substances in relation to each other and furthermore the robustness of the shell can also be varied by having a single shell or by having an additional inner shell or shell wall. An additional inner shell or shell wall for a polyamide shell can be formed by, for instance, an epichlorhydrin polymer which for this purpose can be incorporated in dissolved state with the aforementioned carrier medium dibutyl phthalate together with the ink and the first reactive substance.

The dry toner powder material in accordance with this invention is characterised by forming high color density images as the interfacial polycondensation process lends itself admirably to the inclusion of substantial quantity of coloring matter into microcapsules produced by such process. We have found that in addition to the incorporation of pigments and dyes into the ink which forms part of the encapsulated substance as previously disclosed it is also possible to include dyes in dissolved or dispersed state, where such dyes can be dissolved or dispersed in the binder materials for the pigment as previously listed, in the carrier medium such as dibutyl phthalate and in the epichlorohydrin polymers employed for the formation of an additional shell or shell wall as previously disclosed. Furthermore we have found that dyes can be included in the aqueous phase together with the emulsion stabilizer where upon drying such dye is found to be contained on the outside of the capsular shell and bonded thereto by said emulsion stabilizer. We have also found that it is possible to have dyes adsorbed onto the pigment prior to incorporation thereof in said ink in which case such pigment is dyed firstly by milling or mixing in a dye solution and then dried prior to inclusion into the ink with the binder materials.

It will be realized of course that the pigments and dyes referred to in the foregoing must be so selected that they do not react in any way with the aforementioned two reactive substances and in particular such dyes must not contain free amine groups which may react with the first reactive substance acid chloride.

We have found that in those cases where water dispersible or hydrophilic pigments such as magnetite, ferrite, magnetizable materials and other such like substances are to be included in the encapsulated substance it is necessary to protect such materials from interaction with the aforementioned first reactive substance and render such materials oil dispersible or oleophilic in order to prevent migration of such particulate matter from the oil phase of the ink in the substance to be encapsulated or from the carrier medium into the aqueous outer phase as such migration precludes effective encapsulation.

We have found that such hydrophilic particulate substances can be protected as well as rendered oleophilic by for instance treating or coating the particle surface with silicones either by the so-called fuming process or by wetting or grinding the particles in a solution of silicones followed by removing the solvent, or by coating the particles by any known method of grinding or dispersing in a solution or hot melt of materials such as natural and synthetic waxes such as polyethylene, oils, synthetic resins such as ketone resins, epichlorohydrin polymers, urethanes, polycarbonates, phthalates, acrylics and styrenes, where some of such materials and in particular the acrylics and styrenes can be applied in substantially monomeric form and subsequently polymerized on the particle surface by known methods.

The microcapsular electroscopic marking particles of this invention produced in accordance with the foregoing disclosure form upon drying a free flowing powder which can be readily employed as toner material. However for the purposes of handling, packaging and feeding as well as recycling in certain high speed toner applicators it has been found advantageous to incorporate with the microcapsules substances such as colloidal silica, aluminum silicate, calcium silicate and such like flow improvers. We have also found that such flow improving substances can be admixed with the dry microcapsules or alternatively such flow improving substances can be dispersed in the aqueous phase before or after the substance to be encapsulated is emulsified therein and upon spray drying the aqueous slurry in such cases we have found the flow improving substances to be evenly distributed between the dry microcapsules and in some instances at least in part bonded to the outer shell surface by the dry emulsion stabilizer.

Furthermore we found that while the shell of the microcapsular electroscopic marking particles of this invention is not affected by environmental conditions, certain emulsion stabilizers such as polyvinyl alcohol which remain on the shell surface upon drying are somewhat affected by moisture and thus in high speed toner applicators operating under high relative humidity conditions it may be found desirable to further improve the flow properties of the dry toner material by rendering the residual emulsion stabilizer water insoluble which for instance in the case of polyvinyl alcohol can be attained by adding to the aqueous slurry upon completion of the encapsulation process whilst agitating same for some time a water soluble resin such as a melamine resin which reacts with polyvinyl alcohol and renders same water insoluble. Residual emulsion stabilizer or protective colloids or surface active agents can of course be substantially reduced in quantity by washing the microcapsules with water prior to insolubilizing the emulsion stabilizer and if so desired also after insolubilization in order to remove traces of unreacted materials.

The free flowing dry toner powder material consisting of microcapsular electroscopic marking particles in accordance with this invention can be of polarity suitable for toning of latent images formed by positive or negative electrostatic charges, as desired. Such dry toner powder can be admixed with iron filings for operation in the well known magnetic brush applicators, or with other carrier particles for operation in other toner applicators for instance of the cascade type as is well known. Alternatively in those instances where the encapsulated substance contains magnetite or ferrite or other magnetizable material such dry powder can be employed as a single component toner with a multi magnet roller applicator as is also well known. The dry powder can be applied to tone directly latent images contained on a dielectric or photoconductive surface such as zinc oxide coated paper and fixed thereto or such powder can be employed to tone latent images contained on reusable photoconductors followed by transfer onto plain paper and fixing thereto.

In all instances the toner material can be pressure fixed to the final surface by for instance passage through the nip of a pair of pressure rollers which may be heated if so desired where the pressure applied between such rollers can be of much lower order than that required for pressure fixing toners of the prior art.

The following examples will serve further to illustrate the present invention, however it should be realised that the examples are intended to be read in the illustrative and not restrictive sense as those skilled in the art of electroscopic toner preparation will be able to adapt the teachings of the present disclosure to other materials without departing from the spirit of the invention.

EXAMPLE 1

An ink for a pressure fixable core composition was prepared as follows:

| | |
|---|---|
| Synthetic wax, melting point 170° F., acid number 3–4, saponification number 30–50, Sp. Gr. 0.842 | 6 grms |
| Polybutene oil, viscosity at 100° F. 27–33 cs., Sp. Gr. 0.8373 | 25 grms |
| Isoparaffinic hydrocarbon, boiling range 207–257° C., flash point 172° F., Sp. Gr. 0.782 | 15 grms |
| Granular magnetite, axial ratio 1/1, particle size 0.25 micron, | 50 grms |
| Lecithin | 2 grms |

were milled in an attritor for 2 hours at a temperature of 91°–93° C., following which Dehydrated Castor Oil, 45 poise: 2 grms were added to reduce viscosity and the composition was then milled for further 2 hours.

The first reactive substance terephthaloyl chloride, 6.5 grms, was dissolved in dibutyl phthalate, 10 grms, at 60° C. and the solution was blended with 50 grms of the previously prepared ink.

An emulsification solution was prepared comprising the emulsion stabilizer polyvinyl alcohol, 1.25 grms, dissolved in distilled water, 125 grms.

The ink containing the first reactive substance and the emulsification solution at 70° C. were charged into a Waring blender to emulsify the ink in the form of microdroplets in the size range 5–10 microns suspended in the emulsification solution. The emulsification time was 30 seconds.

The second reactive substance diethylene triamine, 3.7 grms, and a buffer sodium carbonate, 2.0 grms, were dissolved in distilled water, 15 grms, and the solution was stirred into the emulsion. Stirring was continued at slow speed for 6 hours, during which time an interfacial polycondensation reaction took place between the diethylene triamine and the terephthaloyl chloride to form polyamide shells around the ink droplets. The thus formed microcapsules were in a state of suspension in what can be termed as an aqueous slurry containing at least part of the emulsion stabilizer in dissolved state therein.

The slurry was elutriated to remove most of the dissolved emulsion stabilizer polyvinyl alcohol, after which the slurry was spray dried.

The spray dried microcapsules were found to be free flowing. Scanning Electron Microscope (SEM) examination showed the dried microcapsules to be in the size range 5–10 microns and a residue layer formed by traces of polyvinyl alcohol was evident on the microcapsules.

The spray dried microcapsules containing about 35% by weight magnetite formed electroscopic marking particles and were used as single component magnetic toner with a rotating multi-magnet applicator to tone an electrostatic latent image on a charged and exposed binder type zinc oxide photoconductive recording paper. The image deposit was pressure fixed by passage through a pair of pressure rollers. The fixing pressure was 80 lbs. per lineal inch.

The color of the fixed image was not considered to be black enough and the degree of fixing was not considered to be fully acceptable, which was due primarily to the substantially cubic shape of the magnetite particles.

EXAMPLE 2

In Example 1 the granular magnetite was replaced by an acicular magnetite, which was a hydrophobic black synthetic ferrosoferric oxide, oil absorption 40%, axial ratio about 8/1, particle length about 0.35 micron.

The degree of image fixing was considerably improved however image color was still considered to be of insufficient blackness.

EXAMPLE 3

An ink for a pressure fixable core composition was prepared as follows:

| | |
|---|---|
| Synthetic wax, as in Example 1, | 8.5 grms |
| Polybutene oil, as in Example 1, | 40.0 grms |
| Lecithin | 1.7 grms |
| Carbon black | 4.2 grms |
| Acicular magnetite, as in Example 2, | 46.0 grms |

were milled in an attritor for 4 hours at a temperature of 96° C.

Terephthaloyl chloride, 6.5 grms, was dissolved in dibutyl phthalate, 10.0 grms, at 60° C. and the solution was blended with 50 grms of the previously prepared ink.

An emulsification solution was prepared by dissolving 3.22% by weight polyvinyl alcohol in distilled water.

The ink containing the terephthaloyl chloride and 125 grms of the emulsification solution at 70° C. were charged into a Waring blender to emulsify the ink in the form of microdroplets in the size range 2–12 microns. The emulsification time was 30 seconds.

Diethylene triamine, 3.7 grms, and sodium carbonate, 2.0 grms, were dissolved in distilled water, 16 grms, and the solution was stirred into the emulsion. Stirring was continued at slow speed for 6 hours, during which time polyamide shells were formed around the ink droplets.

The slurry containing the thus formed microcapsules was spray dried.

The spray dried capsules contained 5% moisture, which was removed by 6 hours oven drying at 105° C. The oven dried microcapsules were free flowing. SEM examination showed individual microcapsules in the size range 2–12 microns but also aggregates of microcapsules up to 50 microns mean diameter caused by polyvinyl alcohol surrounding the microcapsules. The presence of excessive polyvinyl alcohol on the dried microcapsules also caused a sample exposed to the atmosphere for 24 hours at 60% RH to absorb about 2% moisture which impaired free flowing properties.

The spray dried microcapsules containing about 29% by weight magnetite formed electroscopic marking particles and were used as single component magnetic toner as in Example 1. At 50 lbs. per lineal inch fixing pressure all larger microcapsules and aggregates were found in SEM examination to have been ruptured, but a fixing pressure of 120 lbs. per lineal inch was required to rupture the 2 micron capsules. This gave a well fixed image of good color and reflection density in excess of 1.3, as measured on a Baldwin reflection densitometer. Reabsorption of moisture by the microcapsules eventually caused flow problems in the toner applicator.

EXAMPLE 4

Example 3 was repeated with the exception that most of the polyvinyl alcohol was removed from the slurry by elutriation prior to spray drying. SEM examination showed substantially reduced size aggregates and reduced packing density of aggregates. Moisture reabsorption in 24 hours was 1.4%.

The dried microcapsules were used as single component toner as in Example 1 and at a pressure of 100 lbs. per lineal inch produced a well fixed image deposit of good color and reflection density of 1.5. Reabsorption of moisture eventually still caused some flow problems in the toner applicator.

EXAMPLE 5

Example 4 was repeated with the exception that the elutriated slurry was treated with a reactive melamine condensate prior to spray drying to insolubilize the remaining polyvinyl alcohol. The reactive melamine condensate was water soluble, viscosity 170 cps at 25° C., pH 8.2–8.8. To the elutriated slurry 400 mg of the melamine condensate were added and the pH was adjusted to 5. The slurry was stirred at slow speed for 24 hours to react the polyvinyl alcohol with the melamine condensate. The slurry was then spray dried.

SEM examination of the spray dried product showed a mixture of individual microcapsules within the size range 6–10 microns and aggregates in the size range 10–30 microns. Moisture reabsorption in 24 hours at 60% RH was 0.6%.

The dried microcapsules were used as single component toner as in Example 1 and at a pressure of 80 lbs. per lineal inch produced a well fixed image deposit of good color and reflection density of 1.5. Flow problems in the toner applicator were virtually eliminated.

EXAMPLE 6

Example 5 was repeated with the exception that the acicular magnetite was replaced by a granular ferrite, axial ratio about 1/1, particle length about 0.65 micron.

The degree of image fixing at pressures up to 120 lbs. per lineal inch was not as good as in Example 5. The reflection density of the image was 1.3.

EXAMPLE 7

The slurry of Example 3 was elutriated with water at 90° C. to remove substantially the polyvinyl alcohol. The slurry was then cooled to room temperature and centrifuged to remove the bulk of the water. The microcapsules were then washed with methanol, following which they were slurried in methanol at 25% solids. A ketone-aldehyde resin was dissolved in methanol and added to the slurry, 2% by weight on microcapsule solids. Water was then added to the methanol slurry to precipitate the ketone-aldehyde resin onto the microcapsules to form a hydrophobic layer thereon. The slurry was flushed with water to remove the methanol and then the slurry was diluted with water to about 20% total solids for spray drying.

SEM examination of the spray dried product showed a residue layer on the microcapsules formed by the hydrophobic ketone-aldehyde resin precipitate. Moisture reabsorption in 24 hours at 60% RH was reduced to 0.2%.

The dried microcapsules were used as single component toner as in Example 1 and at a pressure of 120 lbs. per lineal inch produced a well fixed image deposit of good color and reflection density of 1.4. The flow characteristics of the microcapsules were substantially improved.

EXAMPLE 8

An ink for a pressure fixable core composition was prepared as follows:

| | |
|---|---|
| Synthetic wax, as in Example 1, | 10 grms |
| Polybutene oil, as in Example 1, | 50 grms |
| Isoparaffinic hydrocarbon, as in Example 1, | 20 grms |
| Carbon black | 20 grms |

were milled in an attritor for 2 hours at a temperature of 93° C.

Terephthaloyl chloride, 6.5 grms, was dissolved in dibutyl phthalate, 10 grms, at 60° C. and the solution was blended with 50 grms of the previously prepared ink.

An emulsification solution was prepared comprising polyvinyl alcohol, 4 grms, dissolved in distilled water, 125 grms.

The ink containing the terephthaloyl chloride and the emulsification solution at 70° C. were charged into a Waring blender to emulsify the ink in the form of microdroplets in the size range 2–5 microns. The emulsification time was 30 seconds.

Diethylene triamine, 3.7 grms, and sodium carbonate, 2.0 grms, were dissolved in distilled water, 15 grms, and the solution was stirred into the emulsion. Stirring was continued at slow speed for 6 hours, during which time polyamide shells were formed around the ink droplets.

The slurry containing the thus formed microcapsules was elutriated with hot water to remove most of the polyvinyl alcohol, following which the slurry was spray dried. The spray dried microcapsules contained 5% moisture, which was removed by 6 hours oven drying at 105° C.

The dried microcapsules formed electroscopic marking particles and were used as two component toner admixed with magnetic carrier particles in a magnetic brush applicator to tone a negative electrostatic latent image on a charged and exposed binder type zinc oxide photoconductive recording paper. The image deposit was pressure fixed by passage through a pair of pressure rollers. The fixing pressure was 130 lbs. per lineal inch. The image deposit was well fixed and of acceptable reflection density in excess of 1.0.

EXAMPLE 9

The dried microcapsules forming electroscopic marking particles of Example 8 were used as two component toner admixed with glass bead carrier particles in a cascade type applicator to tone a positive electrostatic latent image contained on the surface of a selenium photoconductor. The thus formed image deposit was electrostatically transferred onto plain bond paper and pressure fixed thereon as in Example 8.

EXAMPLES 10 and 11

Examples 8 and 9 were repeated with the exception that the polyvinyl alcohol content was reduced to 2.5 grms in distilled water, 125 grms.

The dried microcapsules were of particle size 4–8 microns and the image deposits produced therewith were pressure fixed at 100 lbs. per lineal inch applied pressure. EXAMPLES 12 and 13.

Examples 8 and 9 were repeated with the exception that the ink for the pressure fixable core composition was prepared as follows:

| | |
|---|---|
| Paraffin wax, melting range 135–140° F. | 20 grms |
| Polybutene oil, as in Example 1, | 45 grms |
| Isoparaffinic hydrocarbon, as in Example 1, | 20 grms |
| Lake red, C.I. pigment Red 3, dispersed in polyethylene, 60% pigment, | 22 grms |

The image deposits were of red color.

EXAMPLES 14 and 15

Examples 12 and 13 were repeated with the exception that the C.I. Pigment Red 3 was replaced by an equal weight of phthalocyanine blue, C.I. Pigment Blue 16.

The image deposits were of cyan color.

EXAMPLE 16

An ink for a pressure fixable core composition was prepared as in Example 3.

Terephthaloyl chloride, 10 grms, was dissolved in dibutyl phthalate, 15 grms, at 16° C. and the solution was blended with 50 grms of the previously prepared ink which was heated to 70° C.

An emulsification solution was prepared by dissolving the emulsion stabilizer sodium hydroxy ethyl cellulose, 3 grms, in distilled water, 300 grms, and adding thereto under gentle stirring 30 grms of a 10% by weight aqueous solution of the surface active agent sodium lauryl sulphate.

The second reactive substance resorcinol, 5.5 grms, and the buffer potassium hydroxide, 5.5 grms, were then dissolved in the above emulsification solution.

The emulsification solution at 60° C. was charged into a Waring blender and under high speed stirring the ink blend was added. High speed stirring was continued for 5 minutes, during which time the ink became emulsified and a reaction took place between the first reactive substance terephthaloyl chloride and the second reactive substance resorcinol whereby polyester shells were formed around the emulsified ink droplets.

The thus formed suspension of microcapsules was poured into 200 mls of acetone and filtered. The microcapsules were washed with methylene chloride and air dried.

The individual microcapsules were generally within the size range 15–25 microns. The microcapsules did not absorb moisture and were very free flowing.

The dried microcapsules formed electroscopic marking particles and were used as single component magnetic toner as in Example 1. The pressure required for fixing was only about 50 lbs. per lineal inch.

EXAMPLE 17.

An ink for a pressure fixable core composition was prepared as in Example 3.

An epoxy resin, melting range 64°–76° C., epoxide equivalent 450–525, 100 grms, was dissolved in dichloromethane, 200 grms. This solution was blended with 50 grms of the previously prepared ink which had been heated to 70° C.

An emulsification solution was prepared by dissolving 2% by weight polyvinyl alcohol in distilled water.

The ink blend and 125 grms of the emulsification solution at 70° C. were charged into a Waring blender to emulsify the ink in the form of microdroplets. The emulsification time was 60 seconds.

Diethylene triamine, 6.3 grms, and sodium hydroxide, 2.8 grms were dissolved in distilled water, 100 grms, and the solution was stirred into the emulsion. Stirring was continued at slow speed for 24 hours, during which time amine curing of the epoxy resin formed a crosslinked epoxy shell around the ink droplets.

The slurry containing the thus formed microcapsules was elutriated with warm water to remove substantially the polyvinyl alcohol. The slurry was then spray dried.

The spray dried microcapsules were generally in the size range 15–25 microns.

The spray dried microcapsules formed electroscopic marking particles and were used as single component magnetic toner as in Example 1. The pressure required for fixing was 80 lbs. per lineal inch.

EXAMPLES 18 and 19

Examples 3 and 4 were repeated, with the exception that the dried capsules were mixed with colloidal silica prior to use as toner material. The silica, particle size 2.9 microns, was mixed with the capsules in the proportion 1% by weight. Such addition of colloidal silica substantially improved the flow characteristics of the capsules without changing toning and pressure fixing characteristics.

EXAMPLES 20 and 21

Examples 3 and 4 were repeated with the exception that 2.9 micron particle size silica was introduced into each of the capsule slurries prior to spray drying, in the proportion 1% by weight of capsule solids. Flow characteristics of the dried capsules were improved as in Examples 18 and 19.

EXAMPLE 22

An ink for a pressure fixable core composition was prepred as in Example 3.

Epoxy resin, epoxide equivalent 600–700, melting range 80°–90° C., 2 grms, was hot dissolved in dibutyl phthalate, 10 grms. This solution was cooled to 60° C. and terephthaloyl chloride, 6.5 grms, was added and also dissolved therein. This solution was then blended with 50 grms of the previously prepared ink.

An emulsification solution was prepared by dissolving 3.22% by weight polyvinyl alcohol in distilled water.

The ink blend and 125 grms of the emulsification solution at 70° C. were charged into a Waring blender to emulsify the ink in the form of microdroplets in the size range 2–12 microns.

Diethylene triamine, 3.7 grms, and sodium carbonate, 2.0 grms, were dissolved in distilled water, 16 grms, and the solution was stirred into the emulsion. Slow speed stirring was continued for 16 hours, during which time interfacial polycondensation caused the formation around the ink droplets of a polyamide outer shell reinforced by a cross-linked epoxy shell predominantly on the inside of the polyamide shell due to the greater mobility of the terephthaloyl chloride in comparison with the epoxy resin and the faster reaction rate of terephthaloyl chloride with diethylene triamine in comparison with the reaction of the epoxy resin therewith.

The slurry was spray dried.

The spray dried microcapsules formed electroscopic marking particles and were used as single component magnetic toner as in Example 1. The pressure required for fixing was 150 lbs. per lineal inch. Reabsorption of moisture by the residual polyvinyl alcohol on the microcapsules eventually caused flow problems in the toner applicator.

EXAMPLES 23 and 24

Example 22 was repeated using the polyvinyl alcohol removal technique of Example 4 and the reactive melamine condensate insolubilising treatment of Example 5, respectively. Flow problems were overcome as in Examples 4 and 5. The fixing pressure was reduced to 130 lbs. per lineal inch due to the substantial removal of the polyvinyl alcohol.

There has been disclosed pressure fixable electroscopic marking particles prepared by interfacial polycondensation in the form of microcapsules of size generally within the range 2–25 microns. Such microcapsules may be spray dried or otherwise dried to produce free flowing toner material either in the form of individual capsules or controlled size agglomerates. Depending on microcapsule shell composition, thickness and presence of a residue layer as described in the foregoing on the shell surface, fixing pressure may be significantly lower than normal with prior art pressure fixable toners. Flow properties of the dried microcapsules depend on the nature of the shell surface and in particular on the nature of the residue layer contained thereon. Dried microcapsules can form electroscopic marking particles even when the residue layer is water soluble or hygroscopic, but to improve flow properties the residue layer can be hydrophobic in nature or can be rendered insoluble in water.

I claim:

1. Electroscopic marking particles comprising microcapsules consisting of a pressure fixable core and pressure rupturable shell encapsulating the core, said shell being formed by interfacial polycondensation in an aqueous dispersion of reactants on and about the core of which at least one reactant is supported by the core during said polycondensation in the aqueous dispersion, and characterized by said core comprising a pressure fixable ink including magnetizable particles selected from the group consisting of magnetite and ferrite, and further characterized in that the magnetizable particles have surfaces treated to be oleophilic before exposure to any aqueous dispersion.

2. Electroscopic marking particles as set forth in claim 1, further characterized by pressure fixable material in said core including a binder and a pigment.

3. Electroscopic marking particles as set forth in claim 1, in which the oleophilic surface is presented by a material selected from the group consisting of an oleophilic silicone, an oil, a wax and an oleophilic resin .

4. Electroscopic marking particles as set forth in claim 1, further characterized by said shell comprising one interfacial polycondensation reaction product selected from the group consisting of polyamide, polyester and epoxy polymers.

5. Electroscopic marking particles as set forth in claim 1, further characterized by said shell containing externally a residue layer selected from the group consisting of ketone resin, surface active agent, sodium hydroxy ethyl cellulose, polyvinyl alcohol and a reaction product between polyvinyl alcohol and a melamine condensate.

6. Electroscopic marking particles as set forth in claim 1, admixed with a flow enhancer selected from the group consisting of calcium silicate, aluminum silicate and colloidal silica.

7. Pressure fixable two component toner comprising electroscopic marking particles as set forth in claim 1, admixed with carrier particles adapted to confer selected polarity onto said electroscopic marking particles.

8. A method of preparing electroscopic marking particles comprising preparing an ink including magnetizable particles selected from the group consisting of magnetite and ferrite, encapsulating a discrete amount of the ink in a shell created thereabout by interfacial polycondensation of reactive components in an aqueous dispersion which form the shell, and treating the particles so the surfaces thereof are oleophilic prior to their being covered or encapsulated in the aqueous dispersion.

9. A method according to claim 1 in which the ink contains a pigment and a binder.

10. A method according to claim 8 or 9 in which the oleophilic surface is selected from the group consisting of oleophilic silicone, oil, wax and oleophilic resin.

* * * * *